United States Patent [19]

Fewkes

[11] 4,101,005

[45] Jul. 18, 1978

[54] WATER POWERED LIFT FOR SPEAKERS APPARATUS

[75] Inventor: Harold L. Fewkes, Buena Park, Calif.

[73] Assignees: Robert J. Little, Bountiful, Utah; Ronald E. Morris, Buena Park, Calif; part interest to each

[21] Appl. No.: 735,499

[22] Filed: Oct. 26, 1976

[51] Int. Cl.[2] ..... A47B 19/00

[52] U.S. Cl. ..... 187/17; 248/188.2; 248/188.5; 248/404; 187/95; 182/148; 272/22

[58] Field of Search ..... 52/7; 108/42, 147; 248/188.2, 404, 441 R, 188.5; 297/347; 312/233, 512; 187/17

[56] References Cited

U.S. PATENT DOCUMENTS

| | | | |
|---|---|---|---|
| 679,529 | 7/1901 | Hitchcock | 248/441 |
| 2,573,794 | 11/1951 | Kueneman | 312/312 X |
| 3,399,887 | 9/1968 | Altier | 52/7 X |

*Primary Examiner*—James C. Mitchell
*Attorney, Agent, or Firm*—Wm. Jacquet Gribble

[57] ABSTRACT

A vertically-oriented hydraulic cylinder has its piston rod attached to a pulpit or a lectern that is vertically guided as the piston is actuated. The hydraulic cylinder contains a column of oil in the cylinder between the piston and a supply line connected to the cylinder and coming from a water main such as a city domestic supply. An exhaust line off the supply line exhausts on the piston downstroke to a drain or sump. Each of the supply line and the exhaust line is controlled by a solenoid operating valve electrically connected to a manual switch. Preferably a limit switch located to be actuated at the bottom of the downward travel of the speaker's apparatus closes the exhaust valve before the oil-water interface in the cylinder reaches the cylinder outlet to the supply line. The supply entry of the cylinder may be baffled to reduce water turbulence to preserve the interface between water and oil in the cylinder.

6 Claims, 8 Drawing Figures

CITY MAIN WATER
DRAIN (SUMP)

WATER POWERED LIFT FOR SPEAKERS APPARATUS

BACKGROUND OF THE INVENTION

In many situations it is desirable to displace vertically the podium or pulpit from which a speaker addresses a congregation or audience. At other times it is desirable to raise the lectern upon which the speaker's material such as notes, Bible, or other reading material is placed. Elaborate mechanisms exist for accomplishing such vertical displacement but are prohibitive for most gathering places. The present invention overcomes cost problems and complicated operation factors of such previous mechanisms by operating from water pressure engendered by city mains and by utilizing standard hydraulic cylinders and solenoid control valves of conventional design to achieve apparatus which is not only inexpensive to install but is moderate in operational cost as well.

SUMMARY OF THE INVENTION

The invention contemplates a hydraulically powered lift for speaker's apparatus such as pulpits, podiums and lecterns which is linkable with a source of water under pressure such as a city water main and comprises a hydraulic cylinder with a piston and piston rod and in which the piston rod is attached to the speaker's apparatus to be lifted. A vertical guide for the apparatus insures stability. Preferably a masking or shrouding element, which may either move with the apparatus or be fixed to an adjacent platform, surrounds the less sightly portions of the mechanism. A supply line from the water main to the cylinder impinges water pressure upon an oil column in the cylinder. Preferably the supply inlet at the cylinder is baffled to avoid turbulence. A drain or exhaust line branches from the supply line to a sump or drain hole.

Each of the supply line and exhaust line is valved and solenoids control the opening and closing of the valves from manual switches preferably under the control of the speaker. A limit switch in the descending path of the apparatus is adapted to close the exhaust valve such that the oil-water interface does not exhaust from the cylinder.

The invention can thus be seen to afford apparatus performing a useful task in a unique way at moderate cost. The mechanism is capable of being shrouded so that the esthetic and traditional appearance of speaker's apparatus need not be altered. The pace of vertical motion may be regulated by proper valves or orifices to suit the varied requirements.

These and other advantages of the invention are apparent from the following detailed description and drawing.

BRIEF DESCRIPTION OF THE DRAWING

In the various figures like parts are identified by like reference numbers.

DESCRIPTION OF PREFERRED EMBODIMENTS

Figures 1, 2, 3:
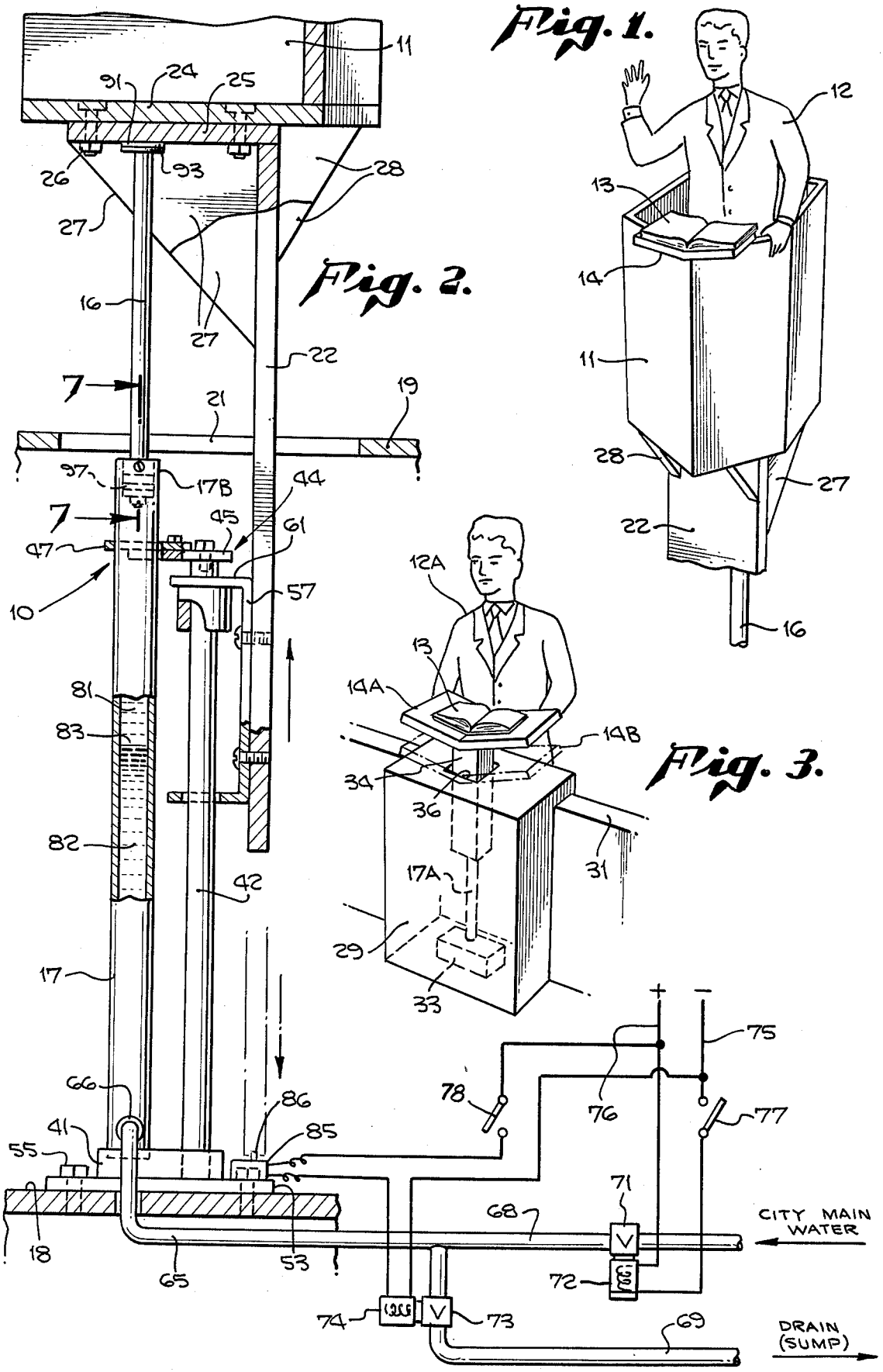
FIG. 1 is a perspective view of a pulpit elevated in accordance with the apparatus of the invention.
FIG. 2 is a fragmentary schematic side elevation, partly in section, of the pulpit lift of FIG. 1 in elevated position.
FIG. 3 is a perspective view of a lectern lift in accordance with the invention.

In FIGS. 1 and 2 a pulpit lift apparatus generally designated by the numeral 10 is shown elevating a pulpit 11 whose occupant 12 has access to written material 13 resting upon a lectern 14 attached to the forward edge of the pulpit.

The pulpit is elevated by a piston rod 16 of a cylinder 17 which rests upon a base 18. The base may be below a podium floor 19 from which the pulpit rises. An opening 21 within the podium floor permits passage of the piston rod and a panel 22 which has the dual function of masking the piston rod and affording stability to the pulpit as it rises.

Both the piston rod and the panel are secured to a bottom 24 of the pulpit by means of a lift plate 25 which is secured by a plurality of bolts 26 to the pulpit bottom. Gussets like the gussets 27 behind the panel gussets and 28 in front of the panel further rigidify the structure which secures the hydraulic cylinder to the pulpit.

In some instances it might be desired to raise the lectern only. Such a situation is illustrated in FIG. 3 where a podium occupant 12A stands at a moveable lectern 14A upon which written material 13 rests. This lectern is elevated above a lowest position 14B (dotted lines). A hydraulic cylinder is indicated in FIG. 3 by the dotted lines 17A which is masked by a podium box 29 interposed in a podium rail 31. The cylinder is mounted upon the floor of the podium by a base 33 to which all controls and hydraulic lines are affixed.

The lectern is fixed to the top of a square sleeve 34 within which the piston rod (not shown) similar to rod 16 of FIG. 2, of cylinder 17A is secured. An aperture 36 in the top of podium box 29 has defining walls which serve to guide the sleeve in its vertical ascent and descent. Since there is no appreciable weight imposed upon the lectern further guidance is not necessary in the embodiment of FIG. 3.

Figure 4:
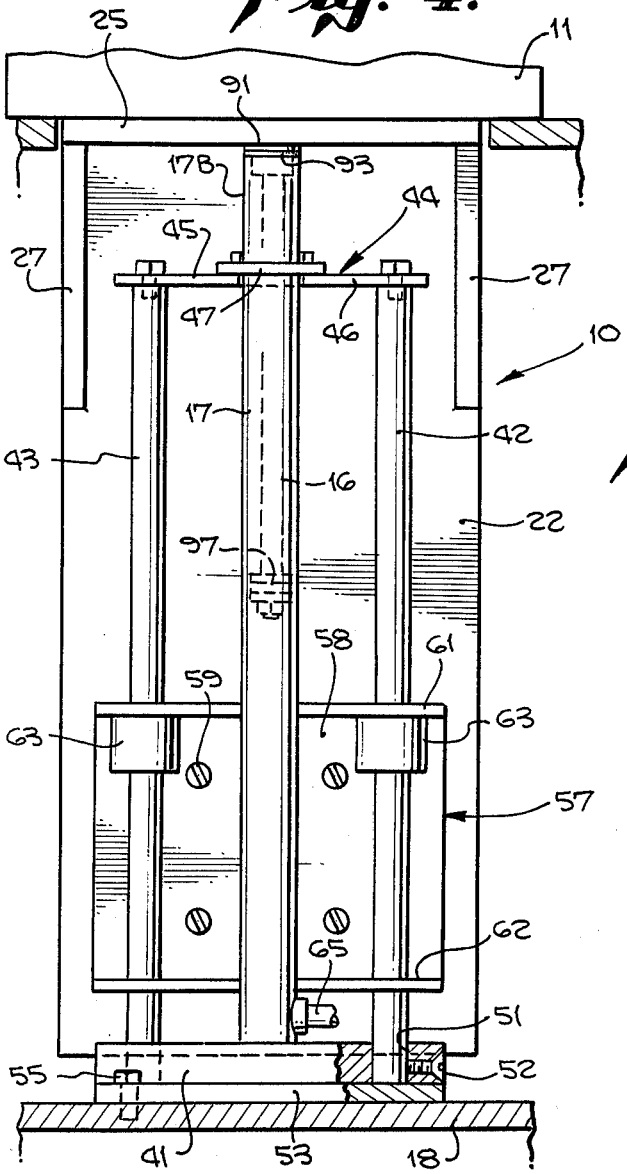
FIG. 4 is a front elevational view of the pulpit lift of FIG. 1.
Figure 5:
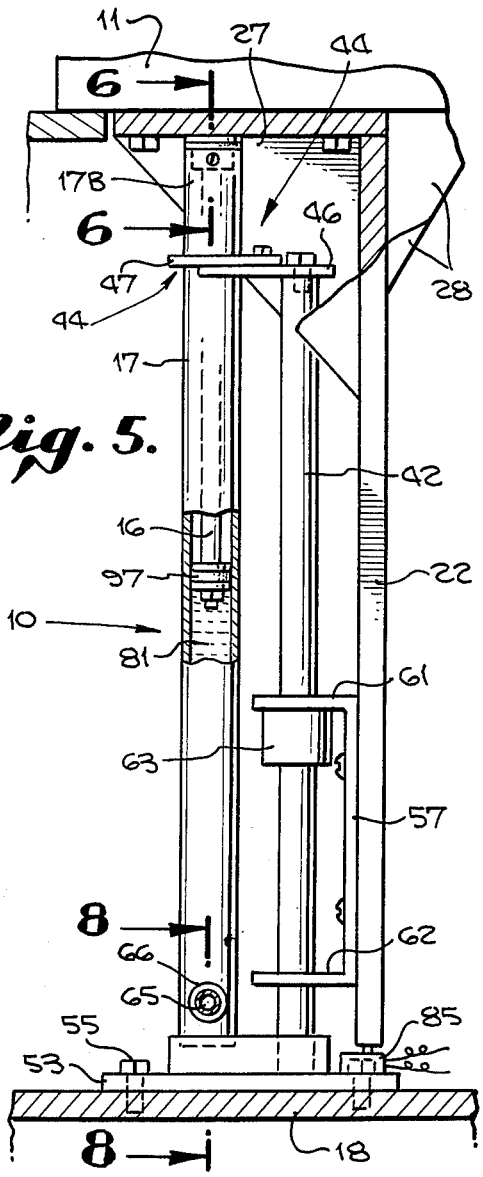
FIG. 5 is a side elevational view, partly in section, showing the apparatus in lowered position.

In the case of the embodiment of FIG. 1, where the full weight of a person is imposed upon the elevating speaker's apparatus, further guide means is necessary as can be seen from FIGS. 2, 4, and 5. The vertical guide means comprises, in addition to the cylinder and piston rod which are fastened in an anchor 41 secured to base 18, a pair of vertical posts 42, 43 secured at their upper ends by a brace assembly 44. The assembly has an arm 45 attached to the end of each post and a tie 47 bolted to the arms and girdling the hydraulic cylinder 17. The cylinder and the posts are thus mutually supporting, their spacing being established by their positions in anchor 41, wherein each bottom end of each post is seated in a recess 51 in the base or anchor and fixed by a set screw 52. A flange 53 of the anchor affords ample anchorage for a plurality of bolts 55 which secure the anchor to base 18.

A bracket 57 is generally U shaped in configuration as shown in FIGS. 2 and 5 where its web 58 is secured to panel 22 by a plurality of screws 59. The bracket has upper and lower flanges 61, 62 respectively and a cylindrical boss 63 depends from each side of upper flange 61 as a journal about the posts 42, 43. The pulpit, in the case of the embodiment of FIG. 1, is thus stabilized in its vertical motion by the mechanical relationship between the vertical cylinder and the vertical posts to which the masking panel 22 of the pulpit is moveably secured.

Turning now to FIG. 2 in which the pulpit is shown in an elevated position, bracket 57 and its flange 61 can be seen to be near the upper limit of travel with respect to posts 42, 43. A water exchange line 65 which enters cylinder 17 at a port 66 branches into a supply segment 68 and a drain segment 69 at a convenient point away from port 66. A normally closed valve 71 controlled by a solenoid 72 is interposed in the supply line 68 between the port 66 and a source of water such as the city mains. A normally closed valve 73 controlled by a solenoid 74 is interposed between drain segment 69 and port 66. Both of the solenoids are connected to a source of power through lines 75, 76, the solenoids being in parallel with the power lines and each in series with a control switch 77, 78 respectively.

In FIG. 2, illustrating the upper position of the pulpit, both switches are shown open, switch 77 having been closed to lift the pulpit by activating solenoid 72 to open valve 71, thus exposing oil column 81 within the cylinder to a supply of water under pressure which results in a standing column 82 of water within the cylinder.

The meeting of the two liquids results in an interface 83 which is preserved because of the basic incompatibility between oil and water; the oil being less dense stays above the interface and because of the surface tensions of the two liquids no diffusion takes place one within the other.

In order to lower the pulpit, switch 78 is closed, activating solenoid 74 to open value 73. Of course, this cycle is accomplished while supply switch 77 is open. It is preferred to use normally open switches which must be held closed to open each of the valves. As valve 73 opens, a gravity drain of the water column 82 within the cylinder takes place and the exhausted water runs to a drain or sump (not shown) with the resultant lowering of the oil column 81 and the interface 83.

By releasing the switch 78, thus closing valve 73, the descent of the pulpit may be stopped at any desired point. Normally, the pulpit is lowered its full cycle in order for the occupant to dismount from the pulpit. Lowering the piston within the cylinder to accomplish this displaces the interface. In order for no oil loss to occur it is desired that the downstroke of the piston and the downward travel of the oil column be limited. Therefore a limit switch 85 is placed on anchor flange 53 with a contact button 86 in vertical alignment with masking panel 22. Limit switch 85 is normally closed and in series with the switch 78 of exhaust valve 73. Therefore, when panel 22 descends, contact 86 is depressed and the circuit is open, resulting in a closure of valve 73, thus maintaining the interface 83 at the desired position within the cylinder above port 66.

Similar limit switching may be used to guard against overelevation of the pulpit if desired.

FIG. 5 shows the position of the piston and panel 22 with respect to limit switch 85 when the pulpit has been lowered.

Figure 6:
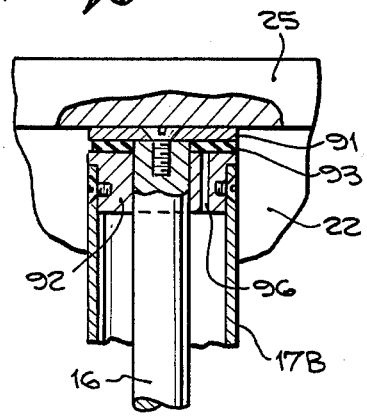
FIG. 6 is a fragmentary sectional elevation taken along line 6—6 of FIG. 5.
Figure 7:
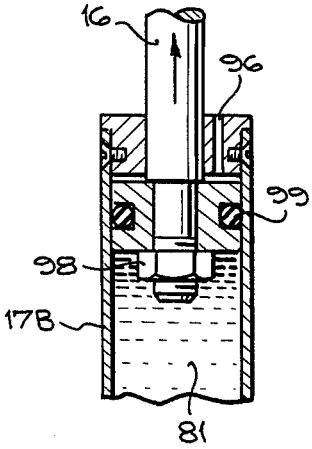
FIG. 7 is a fragmentary sectional elevation taken along line 7—7 of FIG. 2.

The top of the cylinder 17B is shown in section in FIG. 6 where the lift plate 25 is shown. A lift pad 91 intervenes between an end plug 92 of the cylinder and lift plate 25. It may also be desirable that a resilient pad 93 be inserted between the pad and the cylinder plug. An air exchange passage 96 shown in both FIGS. 6 and 7 prevents vacuum or compression buildups from occurring between plug 92 and a piston 97 which rides within the cylinder. The piston may be secured to rod 16 conventionally by threaded means 98 and be sealed with respect to the cylinder wall by a conventional O-ring 99.

Figure 8:
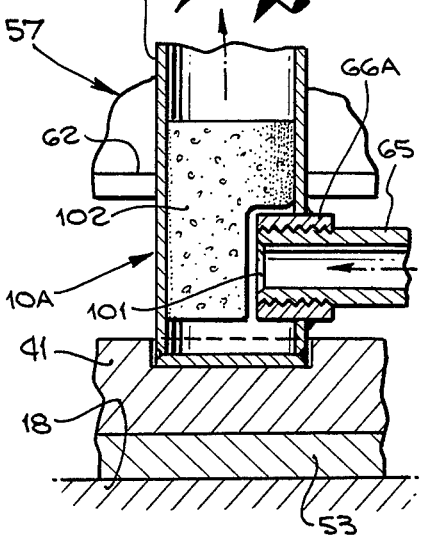
FIG. 8 is a fragmentary sectional elevational view taken along line 8—8 of FIG. 5.

Because of the unique arrangement of impinging a water column upon an oil column in order to move the piston within the cylinder it is desirable to limit the turbulence of the entering water as much as possible. Therefore in FIG. 8 an embodiment of the invention is shown wherein an apparatus 10A with a cylinder 17D has a threaded port 66A in which a water exchange line 65 is engaged. At an entry end 101 of line 65 a perforate body such as a porous plastic member 102 is secured to damp the consequences of water velocity as valve 72 is opened and water under pressure enters the cylinder. Thus the interface between water and the oil column can be re-established without appreciable intermixing of the two liquids.

The apparatus and invention can, from the foregoing be seen to apply equally to heavy and light lifts. Control is simple with conventional valving with a consequent lowering of installation and maintenance costs.

While differing embodiments have been disclosed in the illustrative material herein other modifications within the scope of the invention will occur to those skilled in this particular art. It is therefore desired that the invention be measured by the appended claims rather than by the purely illustrative material of the specification.

I claim:

1. A lift for speaker's apparatus for use with a source of water under pressure and comprising a hydraulic cylinder having a piston and a piston rod, said piston rod being attached to the speaker's apparatus, a vertical guide for the apparatus;

a water supply line to the cylinder, a water exhaust line to the cylinder;

a valve in each of the supply and exhaust lines, means for controlling each valve;

an oil column in the cylinder between the piston and the water supply line, said water and oil forming an intimate interface within the piston travel zone, and means for limiting the downward piston travel in the cylinder such that the interface stays above the supply line.

2. A lift in accordance with claim 1 wherein said limiting means comprises a solenoid control means for each of said valves, and a normally closed limit switch adapted to be contacted by the apparatus on its downward path, to open the solenoid circuit to the exhaust valve.

3. A lift in accordance with claim 1 further comprising a turbulence damper at the entrance of the supply line to the cylinder.

4. A lift in accordance with claim 1 further comprising a mask to one side of the piston rod.

5. A lift in accordance with claim 4 wherein said mask is an element in said vertical guide.

6. A lift for a speaker's apparatus for use with a source of water under pressure and comprising a hydraulic cylinder having a piston and a piston rod; a support pad on the rod, said speaker's apparatus being supported on said pad; a panel depending from said speaker's apparatus, a bracket fixed to said panel, a pair of guide posts parallel to said hydraulic cylinder, an anchor fixing the cylinder and the guide posts at their respective bottoms, spaced journals on said bracket surrounding said guide posts such that the bracket is slidable on the posts; a water supply line to the cylinder, a valve in the line; a water exhaust line to the cylinder, a valve in the exhaust line; a solenoid for each of said valves which when actuated opens said valve; manual switching means controlling each solenoid; an oil column in the cylinder against which the water impinges to form an intimate interface within the piston travel zone, and means for limiting the downward piston travel in the cylinder such that the interface stays above the supply line.

* * * * *